US005187953A

United States Patent [19]

Mount

[11] Patent Number: 5,187,953

[45] Date of Patent: Feb. 23, 1993

[54] FAIL-SAFE APPARATUS FOR PURGE SYSTEM

[76] Inventor: Gordon L. Mount, 8289 Gulf Bridge Rd., West Monroe, N.Y. 13167

[21] Appl. No.: 871,153

[22] Filed: Apr. 20, 1992

[51] Int. Cl.[5] ..... F25B 43/04

[52] U.S. Cl. ..... 62/195; 62/475

[58] Field of Search ..... 62/85, 195, 292, 474, 62/475

[56] References Cited

U.S. PATENT DOCUMENTS 2,920,458 1/1960 Watkins ..... 62/195

3,145,544 8/1964 Weller ..... 62/195

*Primary Examiner*—John Sollecito

[57] ABSTRACT

Provision is made in a refrigeration purge system for sensing certain conditions indicative of failure of components within the system, to responsively shut-down the system and prevent refrigerant from being undesirably vented to the atmosphere. Failure conditions sensed include inadequate cooling medium to the condenser coil and failure of a relief valve.

14 Claims, 2 Drawing Sheets

FAIL-SAFE APPARATUS FOR PURGE SYSTEM

BACKGROUND OF THE INVENTION

This invention relates generally to refrigeration systems and, more particularly, to purge recovery systems for removing noncondensable gases from a refrigeration circuit.

Periodic purging of water and non-condensable gases from a refrigeration circuit is common in large chiller systems. This is commonly accomplished by a way of a so called "thermal purge", wherein the refrigerant and a mixture is caused to flow over a cooling coil to thereby condense the refrigerant from the mixture, with the remaining air then becoming more concentrated so that it can eventually be evacuated by way of a small vacuum pump. This process is enhanced by using a compressor to increase the pressure in the purge chamber, thereby increasing the amount of refrigerant that is condensed. However, even with this improvement there will still be some refrigerant in the non-condensing gases that have entered into the atmosphere. Not only is this a waste of refrigerant which must eventually be replaced, but it also contributes to the undesirable emissions to the Earth's atmosphere.

A further enhancement of the purge process is described in U.S. Pat. No. 4,984,431, assigned to the assignee of the present invention, wherein a carbon filter is placed in the venting circuit such that the discharge gases from the purge chamber pass into the charcoal filter where refrigerant is absorbed. Eventually, the non-condensable gases are released from the filter container and the container is then pumped down to remove the refrigerant from the filter and return it to the refrigeration circuit.

While this enhanced version of a purge system is capable of removing most of the refrigerant from the non-condensable gases prior to their being vented to the atmosphere, it is recognized that a failure within the system may cause an undesirable release of refrigerant to the atmosphere. For example, in the event that there is a loss of or reduction in the flow of coolant medium to the coil in the purge chamber as would occur, for example, if a refrigerant filter were plugged, or if there was dirt in the expansion orifice, or if the water supply were turned off, then the effectiveness of the purge chamber would be substantially diminished, or even curtailed, and would thereby permit the refrigerant to be vented with the non-condensable gases.

Another failure that could occur is that of the relief valve in the pressurized purge chamber. That is, if the relief valve, which is provided to release the non-condensable gases from the purge chamber, fails to open as intended, the purge chamber and the associated piping would become over-pressurized and a failure could occur. This would result in a substantial loss of refrigerant to the atmosphere. On the other hand, if the relief valve fails in the open position, such as would occur if a spring breaks, then the effect of a compression within the purge chamber would be negated and the degree of condensation would be substantially reduced. Again, this would result in increased quantities of refrigerant being vented to the atmosphere.

Another possibility for failure within the system is that of the solenoid valve which vents the storage tank, or in the case of the system of the above-mentioned patent, the carbon filter tank, to the atmosphere. If this valve fails to open as designed, the system can again become over-pressurized, in which case a rupture could occur to thereby allow the unpressurized flow of a refrigerant mixture from the carbon filter tank.

It is therefore an object of the present invention to provide an improved purge recovery system for a refrigerant circuit.

Another object of the present invention is the provision in a purge recovery system for fail-safe operation.

Another object of the present invention is the provision in a purge recovery system for a shut-down of the system in the event of certain predetermined undesirable conditions being detected.

These objects and other advanced features and advantages become more readily apparent upon reference to the following description when taken into conjunction with the appended drawings.

SUMMARY OF THE INVENTION

Briefly, in accordance with one aspect of the invention, pressure and temperature sensors are installed at prescribed locations in the purge chamber such that they are effective to sense conditions indicative of possible failures within the system. Signals indicative of these sensed conditions are then applied to a switching mechanism to turn off power to the purge system.

In accordance with another aspect of the invention, a temperature sensor is placed on the condensing coil of the purge chamber to sense when the temperature thereof reaches a predetermined level indicative of inadequate supply of coolant medium. When this condition is sensed, a switching device is activated to cause a shut-down of the purging system.

By yet another aspect of the invention, pressure sensors are installed on the purge chamber to sense when the relief valve fails either in the open or closed condition. In response, a switch is activated to cause a shut-down of power to the purging system.

In the drawings that are hereinafter described, a preferred embodiment is depicted; however, various other modifications and alternative constructions can be made thereto without departing from the truth spirit and scope of the invention.

DESCRIPTION OF THE PREFERRED EMBODIMENT

Figure 1:
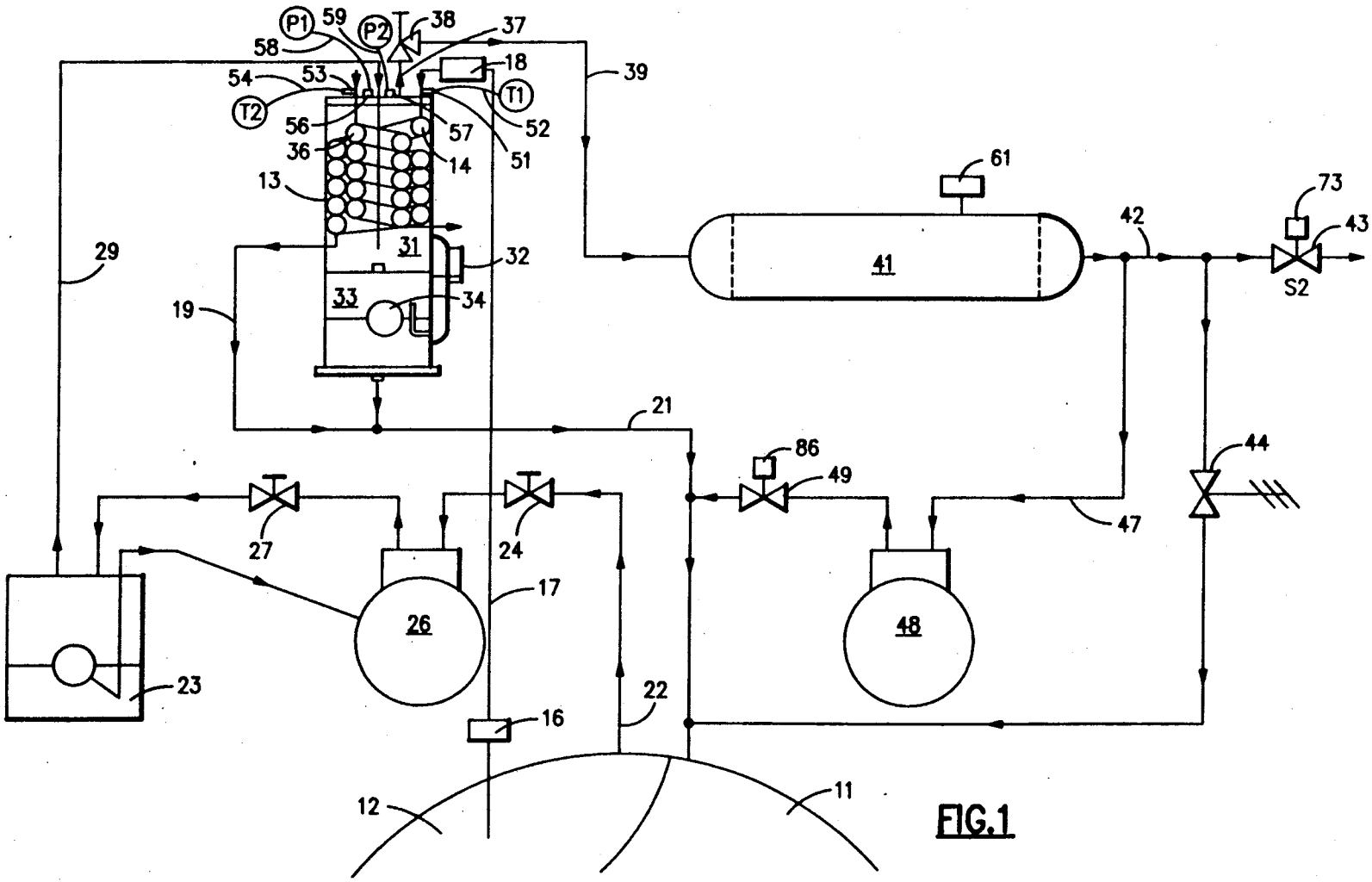
FIG. 1 is a schematic illustration of a typical refrigeration purge system with the present invention incorporated therein.

Referring now to FIG. 1, there is shown a purge system for a refrigeration circuit which includes an evaporator or cooler 11, a condenser 12 and a purge chamber 13. The cooler 11 and condenser 12 are installed in a conventional manner to form a part of a refrigeration circuit (not shown) which includes an expansion device for introducing refrigerant vapor into the cooler 11 and a compressor which then compresses the heated Vapor coming from the cooler 11 before it passes on to the condenser 12.

The purge chamber 13 contains a condenser coil 14 which operates in a somewhat conventional manner to cool the mixture of non-condensable gases and a condensable refrigerant such that the refrigerant is condensed and thereby separated from the non-condensable gases. The condenser coil 14 is cooled by way of refrigerant that passes from the condenser 12 in the liquid form, through a filter 16 and a conduit 17 to an orifice 18, where it is flashed into vapor which then flows to the condenser coil 14 where it performs a cooling function and then passes (in the liquid form) along conduits 19 and 21 to the cooler 11.

Refrigerant needing to be purged of air originates in the condenser 12 from which the refrigerant, together with the mixture of non-condensable gases and water vapor, passes from the condenser 12 along the conduit 22, valve 24 and compressor 26, where the pressure of the gas mixture is increased to about 45 psi. It then passes to a valve 27 an oil separator 28, a mixed gas input Line 29, and finally to the purge chamber 13. Since most of the gas mixture is condensable and is at the approximate temperature of, and at a higher pressure than, the cooler 11, water vapor and refrigerant gas will condense and fall to the bottom of the purge chamber 13. Since the water is lighter than the refrigerant, it will separate in an upper compartment 31 from which it can be drawn off through valve 32. The heavier refrigerant passes into a lower float chamber 33, and as the refrigerant level in the chamber rises, a float valve 34 is automatically opened to allow the liquid refrigerant to pass along Line 21 to the cooler 11.

As an alternative to the refrigerant coil 14, a second coil 36 is provided in the purge chamber 13 for use in condensing the refrigerant therein during periods in which the refrigerant system is not in operation. Thus, the cooling medium used in the purge chamber 13 will be either refrigerant passing through the coil 14 during normal operation or water passing through the coil 36 when the main compressor is not operating.

At the top of the purge chamber 13 is a mixed gas discharge Line 37 leading to a 45 psi relief valve 38 and hence to a conduit 39 and a storage or filter tank 41. The filter tank 41 is filled with an absorbent carbon material which functions to absorb any refrigerant that may remain in the mixed gas flowing from the discharge Line 37. The material that has been found suitable for use in the filter tank 41 is a granulated activated carbon, typed BPL-F3, which is commercially available from Calgon Carbon Corporation.

At the discharge end of the carbon tank 41 is a conduit 42 leading to a solenoid valve 43. The valve 43 is pressure responsive so as to be operable to open when the pressure in the conduit 42 reaches a predetermined level such as 10 psig. For safety purposes, a second relief valve 44 is connected to the conduit 42 and is set at a higher pressure, such as 25 psig, so that in the event the solenoid valve 43 fails to open, the relief valve 44 will eventually open and discharge the vapor from the filter tank 41 to the cooler by way of conduit 46.

Also connected to the conduit 42 by conduit 47 is a vacuum pump 48 leading to a solenoid valve 49 and finally to the conduit 21 leading back to the cooler li. Its purpose is to reactive the carbon filter by drawing down the pressure in the tank 41 from a 10 psig condition to a vacuum of about 27 inches of mercury to scavenge the refrigerant vapors that have been trapped in the carbon and return them to the cooler 11 by way of the solenoid valve 49.

Recognizing that failure of certain components or failure by the operator to follow the prescribed procedures for the purging process, can result in the refrigerant being vented to the atmosphere, there are fail-safe features that are included to sense when a faulty condition exists and to then shut-down the purging system. Thus, in order to detect a condition where there is an inadequate flow of cooling medium to the purge chamber 13, a bimetal thermostat is placed in direct contact with the inlet portion of the condensing coil within the purge chamber 13 and is connected to a thermal switch. For the refrigerant coil 14, a thermostat 51 and its associated lead 52 send signals to a thermal switch T-1. For the cooling water coil 36, a thermostat 53 a lead 54 send signals to a thermal switch T-2. Thus 52 leads and 54 provide signals representative of coil temperatures switches T-1 or T-2 for opening or closing the switches in a manner to be described hereinafter.

Yet another possible failure within the system is that of the relief valve 38 failing in either the open or closed condition. To sense these conditions, a pair of pressure sensors 56 and 57, together with their associated lines 58 and 59 are provided for sensing the pressure within the purge chamber 13 and to cause operation of low or high pressure switches P-1 or P-2 to responsively shut-down the purge system when prescribed low or high pressure conditions are sensed. The operation of the switches P-1 and P-2 is more fully described hereinafter.

As part of the system to provide fail-safe operation, it is desirable to monitor the pressure within the filter tank 41 and to responsively operate a switch in a manner to be described hereinafter. For that purpose, a pressure switch 61 is provided as shown in FIG. 1.

Figure 2:
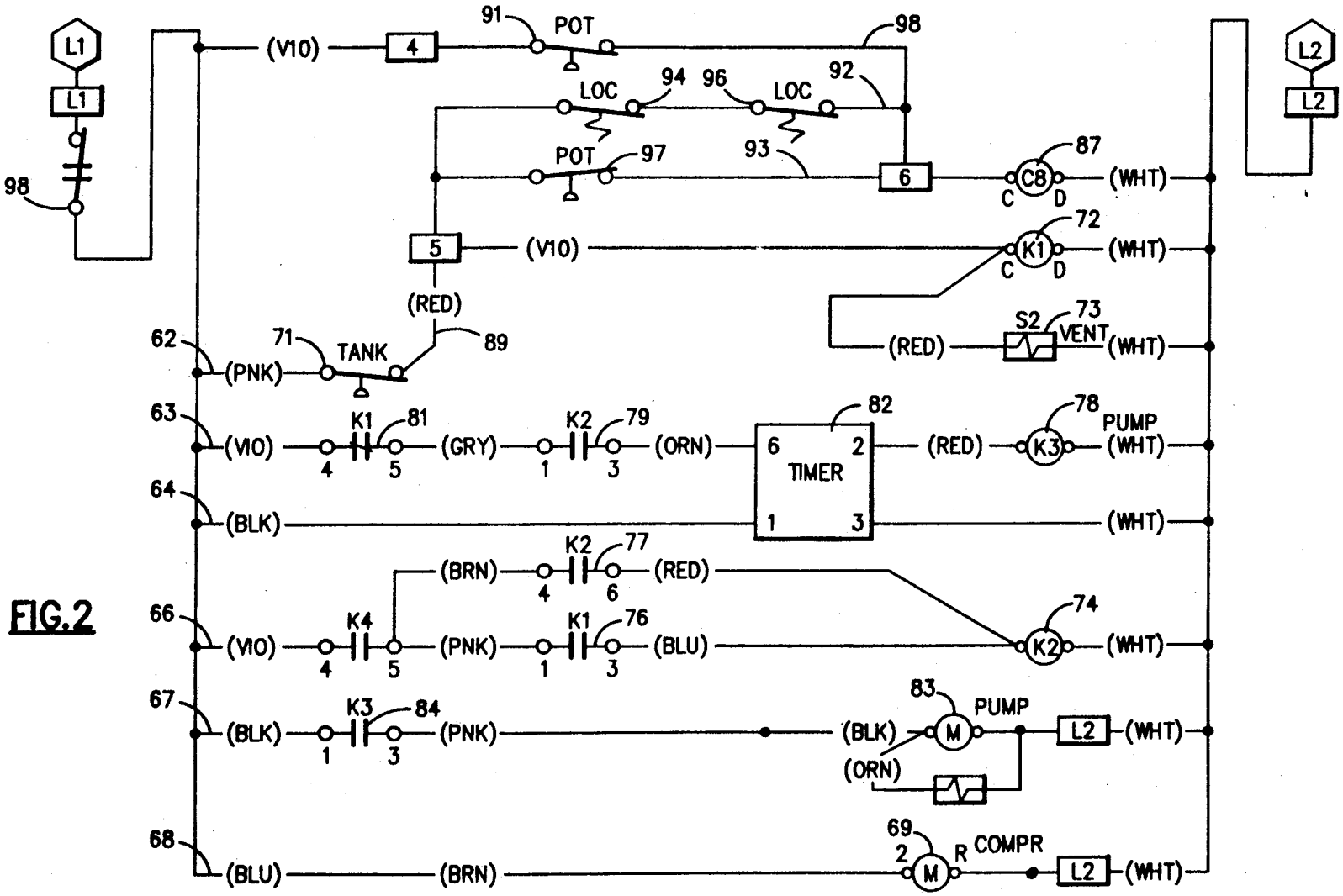
FIG. 2 is a schematic illustration of the electrical control circuit therefor.

Referring now to FIG. 2, electrical control circuitry is shown in schematic form to include lines 62, 63, 64, 66, 67, and 68 in parallel between power leads L1 and L2, which are automatically energized whenever the machine compressor is in the operating condition. The motor 69 for the compressor 26 is connected in Line 68. In Line 62, the pressure switch contacts 71, which are caused to close when the solenoid valve 43 opens at 10 psi, are in series with the K1 relay coil 72, which in turn is in parallel with the solenoid coil 73 of solenoid valve 43. In Line 66, the K2 relay coil 74 is in series with K1, normally open, relay contacts 76, which in turn has the K2, normally open, relay contacts 77 in parallel therewith. In Line 63, the K3 relay coil 78 is in series with the K2, normally open relay contacts 79 and the K1, normally closed relay contacts 81. A single shot timer 82 is connected across lines 63 and 64 as shown. Finally, the motor 83 for the vacuum pump 48 is connected in Line 67, in series with the K3, normally open relay contacts 84 and in parallel with the solenoid coil 86 of solenoid valve 49.

In operation, the compressor motor 69 runs continuously whenever the machine compressor is in operation and power is provided by way of lines L1 and L2, to pull refrigerant vapor with mixed non-condensable gases from the machine condenser 12 by way of Line 22 to thereby pressurize the purge chamber 13. As air accumulates, the pressure in the purge chamber 13 rises until the relief valve 38 opens (e.g. at 45 psi), thereby allowing the pressurized refrigerant/non-condensable gas mixture to flow into the carbon container 41. The carbon in the container 41 absorbs the refrigerant vapor and the accumulating air increases the pressure in the container 41. When the pressure reaches a predetermined level (e.g. 10 psi) the tank pressure switch 61 causes the pressure switch contacts 71 to close to thereby energize the air vent solenoid coil 73 to vent the air and to activate the K1 relay coil 72. In turn, the K1, normally open relay contacts 76 are caused to close to thereby energize the K2 relay coil 74, and the K1, normally closed, contacts 81 in Line 63 are caused to open. Activation of the K2 solenoid coil 74, in turn, closes the K2, normally open, contacts 77 and 79. At this point, the lines 62, 66 and 64 have completed circuits and the lines 63 and 67 have open circuits.

While the carbon tank pressure switch 61 is designed to close its contacts 71 at 10 psig, it is designed to open the contacts 71 when the pressure drops below 2.5 psig. Because of the air vent solenoid 43 being open to vent the air from the carbon tank 41, the pressure in the tank eventually drops to 2.5 psig, which causes the pressure switch contacts 71 to open to thereby inactivate the K1 relay coil 72. This, in turn, opens the K1 relay contacts 77 and closes the K1 relay contacts 81 to thereby start the single shot timer 82 and activate the K3 relay coil 78. The K3, normally open, contacts 84 in Line 67 then close to activate the vacuum pump motor 83 and the solenoid valve coil 86. The cycle timer 82 is then set to run for five minutes, during which time the vacuum pump 48 proceeds to draw the pressure in the tank 41 down from the 2.5 psig condition to a vacuum of about 27 inches of mercury to scavenge the refrigerant vapors that have been trapped in the carbon and return them to the machine cooler 11 by way of the solenoid valve 49. After five minutes of operation, the single shot timer 82 turns off, the relay coil 78 is inactivated to open the contacts 84 and shut off the vacuum pump motor 83, and the cycle is complete.

Referring now to the fail-safe features of the present invention as discussed hereinabove, the electrical components related to the sensors 51, 53, 56 and 57 of FIG. 1 are shown in FIG. 2. A circuit breaker coil 87 has its one terminal connected to the L2 power lead and its other terminal connected to the L1 power lead by way of lines 88 and/or 89, when the circuits in those lines are complete. This occurs in Line 88 when the normally open contacts 91 are closed, as would be caused to occur when the high pressure switch P-2 at the purge chamber 13 is activated at 60 psig. The high pressure switch P-2 automatically resets to the open position when the pressure in the purge chamber 13 drops to 40 psig.

In order for Line 89 to be connected to the power Line L1, it is necessary that the tank pressure switch contacts 71 be closed, as will occur when the tank reaches a pressure of 10 psig. The Line 89 is, in turn, connected to the other terminal of the circuit breaker coil 87 by either of a pair of lines 92 or 93 when their switches are closed. The circuit in Line 92 is complete only when both the contacts 94 and the contacts 96 are closed, which occurs only when the thermal switches T-1 and T-2, respectively, are triggered as will occur when the temperature at the inlet of the respective coils reaches 90° F. The thermal switches T-1 and T-2 are automatically reset to the open position when the temperatures at those inlets drops to 75° F.

The Line 93 circuit will be complete when the contacts 97 are closed when its switch P-1 is triggered as will occur when the pressure in the purge chamber 13 drops to 15 psig or less. The switch P-1 is designed to automatically reset to the open position when the pressure reaches 30 psig.

In operation, considering first the thermal switches T-1 and T-2, it will be understood that the usual method of operation will be to use the refrigerant coil 14 for the condensation process, in which case the water cooled coil 36 would not be in use. If for some reason the supply of refrigerant is not adequate, the temperature at the inlet to the coil 14 will eventually reach 90° F., and the thermal switch T-1 will cause the contacts 96 to close. Since no coolant would be flowing into the inlet of coil 36, the thermal switch T-2 would also cause the contacts 94 to close. If, in the meantime, the pressure in the carbon tank 41 has risen to 10 psig, then the pressure switch 61 will have caused the contact 71 to close and the circuit in Line 62 will be complete to activate the circuit breaker coil 87. If not, the purge system will continue to operate until the pressure in the tank 41 does reach that level and the circuit breaker coil 87 will be activated. This will, in turn, cause the normally closed contacts 98 of the circuit breaker 87 to open and to thereby cut off the power from L-1 to de-active the purge system. Since the circuit breaker 87 is a manually resettable, single pole unit, the purge system will remain in the off condition until a serviceman can check out the system and reset the circuit breaker to the normally closed position.

The other possibility of failure in the relief valve 38 is that of being stuck in the open position such as would occur if the spring breaks. In such case, the purge chamber 13 would not become pressurized and the refrigerant and air mixture would flow freely to the carbon tank 41 and eventually be released to the atmosphere by way of the solenoid valve 43. In such case, the pressure in the tank 41 would increase to the 10 psig level such that the switch contacts 71 would be closed. However, since the pressure in the purge chamber 13 would be below the predetermined threshold for the low pressure switch P-1 (e.g. 15 psig), then the switch contacts 97 would close and the circuit would be complete to trip the circuit breaker coil 87 and open the contacts 98 to shut-down the system. If the low pressure condition is a temporary condition and the pressure in the purge chamber eventually rises to the predetermined threshold level to open the switch contacts 97 (e.g. 30 psig), then the switch P-1 will be automatically reset to the open position.

While the present invention has been disclosed with particular reference to a preferred embodiment thereof, the concepts of this invention are readily adaptable to other embodiments, and those skilled in the art may vary the structure thereof without departing from the essential spirit of the invention.

What is claimed:

1. An improved purge recovery system of a type having a purge chamber, a refrigerant condensing coil in the purge chamber by way of a cooling medium passing through the coil, and a vent circuit for removing non-condensable gases from the purge chamber, wherein the improvement comprises:

means for sensing when the temperature of the coil reaches a predetermined temperature limit indicative of an inadequate supply of cooling medium to the coil; and switching means responsive to said temperature sensing means for turning off the purge recovery system when said predetermined temperature limit is exceeded.

2. An improved purge recovery system as set forth in claim 1 wherein said temperature sensing means comprises a thermostat attached near an inlet end of the coil.

3. An improved purge recovery system as set forth in claim 1 wherein said sensing means comprises a normally open temperature switch in series with a circuit breaker which operates to shut-down the purge recovery system.

4. An improved purge recovery system as set forth in claim 3 wherein said cooling medium is refrigerant.

5. An improved purge recovery system as set forth in claim 1 wherein said cooling medium is water.

6. An improved purge recovery system as set forth in claim 3 and including a second coil for condensing refrigerant in the purge chamber by way of a cooling medium passing through said second coil.

7. An improved purge recovery system as set forth in claim 6 wherein said switching means includes a second normally open switch in series with said circuit breaker.

8. An improved purge recovery system as set forth in claim 1 and including a storage tank connected to receive vapor from the purge chamber by way of a regulating valve, with said storage tank, in turn, being vented to the atmosphere by way of a normally closed solenoid valve.

9. An improved purge recovery system as set forth in claim 8 wherein said storage tank includes a normally open pressure switch that closes in response to the pressure in said purge tank reaching a predetermined level, and further wherein said normally open switch is in series with said switch means and a circuit breaker that operates to shut down the purge recovery system.

10. An improved purge recovery system as set forth in claim 8 wherein said solenoid valve is pressure responsive to open at a predetermined pressure in said storage tank, and further including a relief valve fluidly connected to a Line between said storage tank and said solenoid valve, said relief valve being responsive to open at a pressure above said predetermined pressure.

11. An improved purge recovery system as set forth in claim 10 wherein said relief valve is connected to discharge to a closed-loop refrigeration system when it opens.

12. An improved purge recovery system as set forth in claim 8 wherein said storage tank contains a filter medium for absorbing refrigerant.

13. An improved purge recovery system as set forth in claim 9 and including a pressure sensing means connected to the purge chamber for closing a second normally open pressure switch in response to the pressure in the purge chamber dropping below a predetermined level indicative of failure of said regulating valve to close, said second normally open pressure switch being in series with the circuit breaker.

14. An improved purge recovery system as set forth in claim 8 and including a pressure sensing means connected to the purge chamber for closing a normally open pressure switch in response to the pressure in the purge chamber rising above a predetermined level indicative of a failure of said regulating valve to open, said normally open pressure switch being in series with the circuit breaker.

* * * * *